US007025610B2

(12) United States Patent
Demuth

(10) Patent No.: US 7,025,610 B2
(45) Date of Patent: Apr. 11, 2006

(54) PLUG CONNECTOR ARRANGEMENT

(75) Inventor: Ulrich Demuth, Erbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/823,217

(22) Filed: Apr. 13, 2004

(65) Prior Publication Data

US 2005/0026484 A1 Feb. 3, 2005

(30) Foreign Application Priority Data

Apr. 16, 2003 (EP) ..... 03008953

(51) Int. Cl.
*H01R 13/62* (2006.01)

(52) U.S. Cl. ..... 439/157; 439/372

(58) Field of Classification Search ..... 439/157, 439/544, 310, 372, 152–160, 347, 489, 352, 439/488, 557, 549, 341–343
See application file for complete search history.

(56) References Cited

U.S. PATENT DOCUMENTS

| | | | | |
|---|---|---|---|---|
| 6,325,647 | B1 * | 12/2001 | May et al. | 439/157 |
| 6,332,789 | B1 * | 12/2001 | Okabe | 439/157 |
| 6,461,177 | B1 * | 10/2002 | Saka et al. | 439/157 |
| 6,558,176 | B1 * | 5/2003 | Martin et al. | 439/157 |
| 6,783,388 | B1 * | 8/2004 | Matsushita | 439/489 |
| 6,824,406 | B1 * | 11/2004 | Sharples et al. | 439/157 |

* cited by examiner

*Primary Examiner*—P. Austin Bradley
*Assistant Examiner*—Edwin A. Leon
(74) *Attorney, Agent, or Firm*—Barley Snyder LLC

(57) ABSTRACT

An electrical connector arrangement having a first connector which is arranged in a housing and may be brought into an electrical connection with a mating connector by the actuation of an actuation lever arranged movably on the first connector. The actuation lever being movable between a free position in which the two connectors are not fully mated and a coupled position in which the two connectors are fully mated. A portion of the actuation lever is disposed between the first connector and the housing with a clamping projection on the lever that is in engagement with a mating clamping projection on the housing when the actuation lever is in the coupled position.

31 Claims, 8 Drawing Sheets

PLUG CONNECTOR ARRANGEMENT

FIELD OF THE INVENTION

The invention relates to an electrical plug connector arrangement having a connector arranged in a housing and an actuation lever movably arranged on the connector or the housing to bring the connector into mating connection with a mating connector by the actuation of the actuation lever.

BACKGROUND OF THE INVENTION

Plug connector arrangements are used in many locations within an automobile to make electrical connections. For example, in the engine compartment or on a gear of a motor vehicle electrical connections are typically needed. These connections, however, may be exposed to violent-jolting and vibration forces. These jolting and vibration forces result in considerable mechanical loads, in particular on the cables leading from the plug connector arrangement and the electrical contacts connected to these cables and involved in the plug connection. These forces occur, both in the mating direction (i.e., axial to the connectors) and transversely with respect to the mating direction (i.e., the radial direction), and may cause mechanical failures in the electrical connections. Also, these jolting and vibration forces can cause undesirable rattling.

SUMMARY OF THE INVENTION

The invention provides an electrical plug connector arrangement capable of taking up loads directed in the radial direction and reducing rattling caused by radial jolting and vibration forces. In an exemplary embodiment of the invention, an electrical plug connector arrangement has a plug or socket connector which is arranged in a housing and may be brought into an electrical contact with a mating connector by the actuation of an actuation lever arranged movably on the connector. This actuation lever is movable between a free position in which the two connectors are not in an electrical contact (unmated) and a coupled position in which the two connectors are in an electrical contact (mated). The actuation lever has a clamping projection extending therefrom between the connector and the housing. When the actuation lever is in the coupled position, the clamping projection is in engagement with a mating clamping projection on the housing, opposite the clamping projection on the lever.

Because the clamping projection on the lever comes into engagement with the mating clamping projection of the housing when the actuation lever moves into the coupled position, the actuation lever and the surrounding housing are clamped to one another in the radial direction such that relative radial movement between the two is restrained. Radial jolting and vibration forces are thus taken up by the surrounding housing and so do not create a load on the electrical contacts of the connectors which are involved in the plug connection.

The actuation lever may be constructed such that it is linearly movable relative to the connector, for example by being guided such that it is movable in a guide rail which is on the outside of the connector and runs perpendicular to the direction in which-the plug connector is plugged in. In one embodiment of the invention, the actuation lever is constructed as a pivotal actuation lever which is pivotal relative to the connector.

BRIEF DESCRIPTION OF THE DRAWINGS

The invention will be explained in more detail below with reference to an exemplary embodiment. In the accompanying drawings.

DETAILED DESCRIPTION OF THE INVENTION

Figure 1:
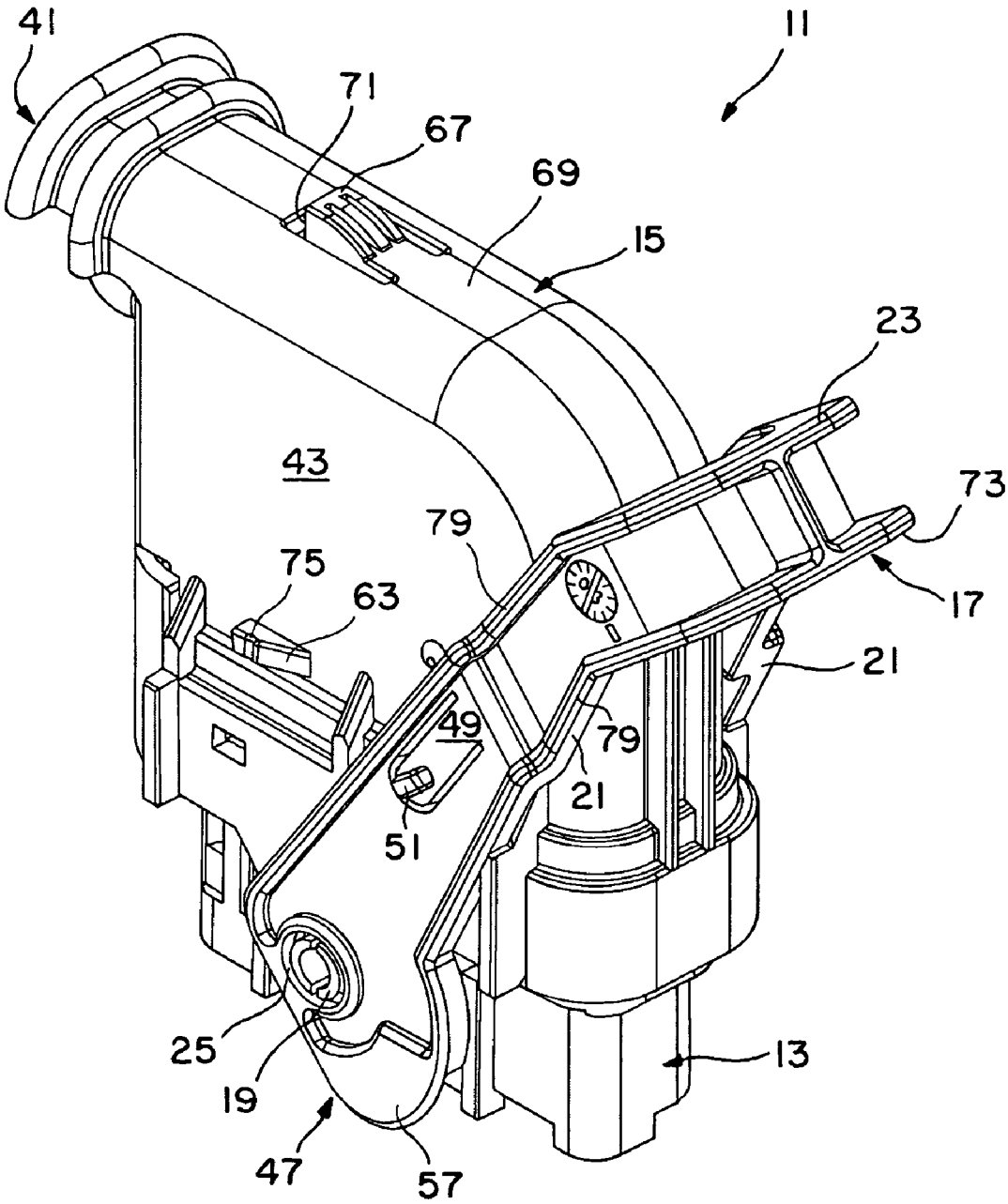
FIG. 1 shows a perspective view of a plug connector provided with a plug cover and an actuation lever, according to an exemplary embodiment of the invention, with the actuation lever in the free position.

FIG. 1 shows a perspective illustration of an electrical connector arrangement 11 according to an exemplary embodiment of the invention, having a socket connector 13. The socket connector has contacts (not shown) at one end (the bottom in FIG. 1) and a cable extending from the other end (not visible in FIG. 1). The cable end of the socket connector 13 is covered by a connector cover 15. An actuation lever 17 is articulated to the connector cover 15 such that it can pivot by means of pivot pegs 19 (of which only one is visible in FIG. 1). The actuation lever 17 is a two-armed pivotal lever that is substantially U-shaped. To this end, each of two lever arms 21, together with a handle 23 having a stirrup shape, form the U-shaped actuation lever 17. The lever arms 21 are each provided with a pivot peg receiving opening 25 at a free end 47 of the lever arm 21 remote from the handle 23.

Figure 2:
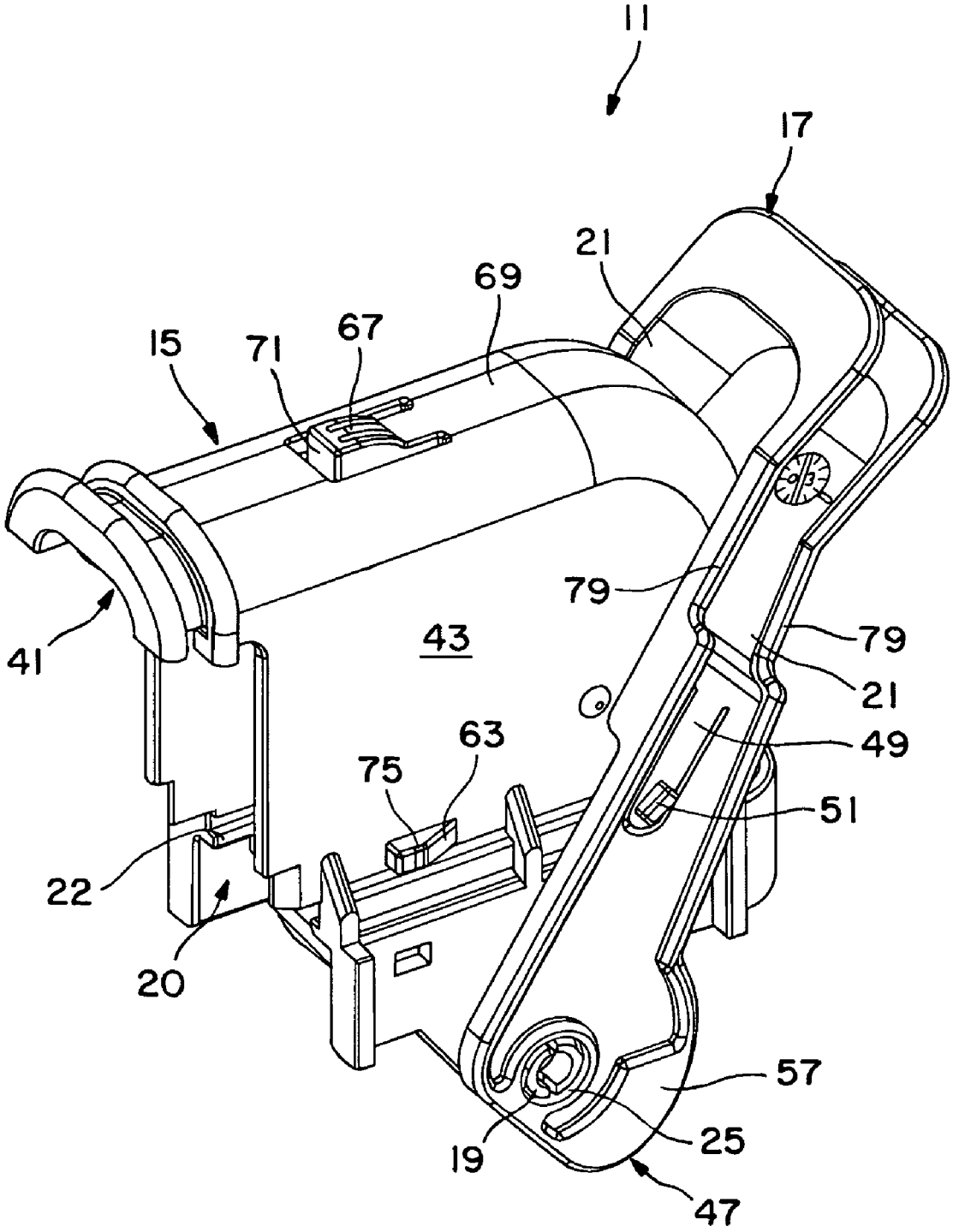
FIG. 2 shows the plug cover and the actuation lever of FIG. 1 with the plug connector omitted and with the actuation lever in the free position.
Figure 3:
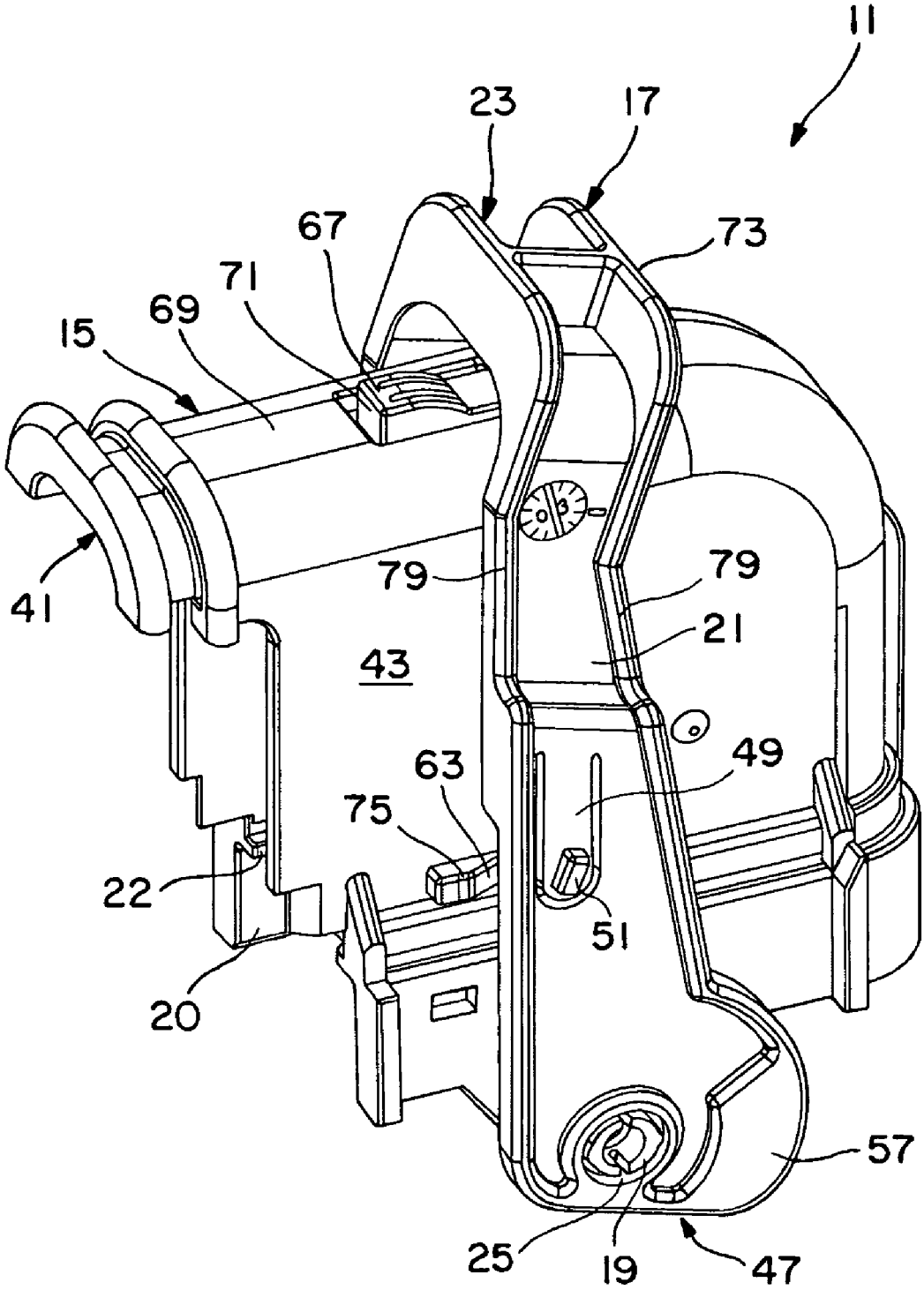
FIG. 3 shows the plug cover and the actuation lever of FIG. 2, with the actuation lever between the free position and the coupled position.
Figure 4:
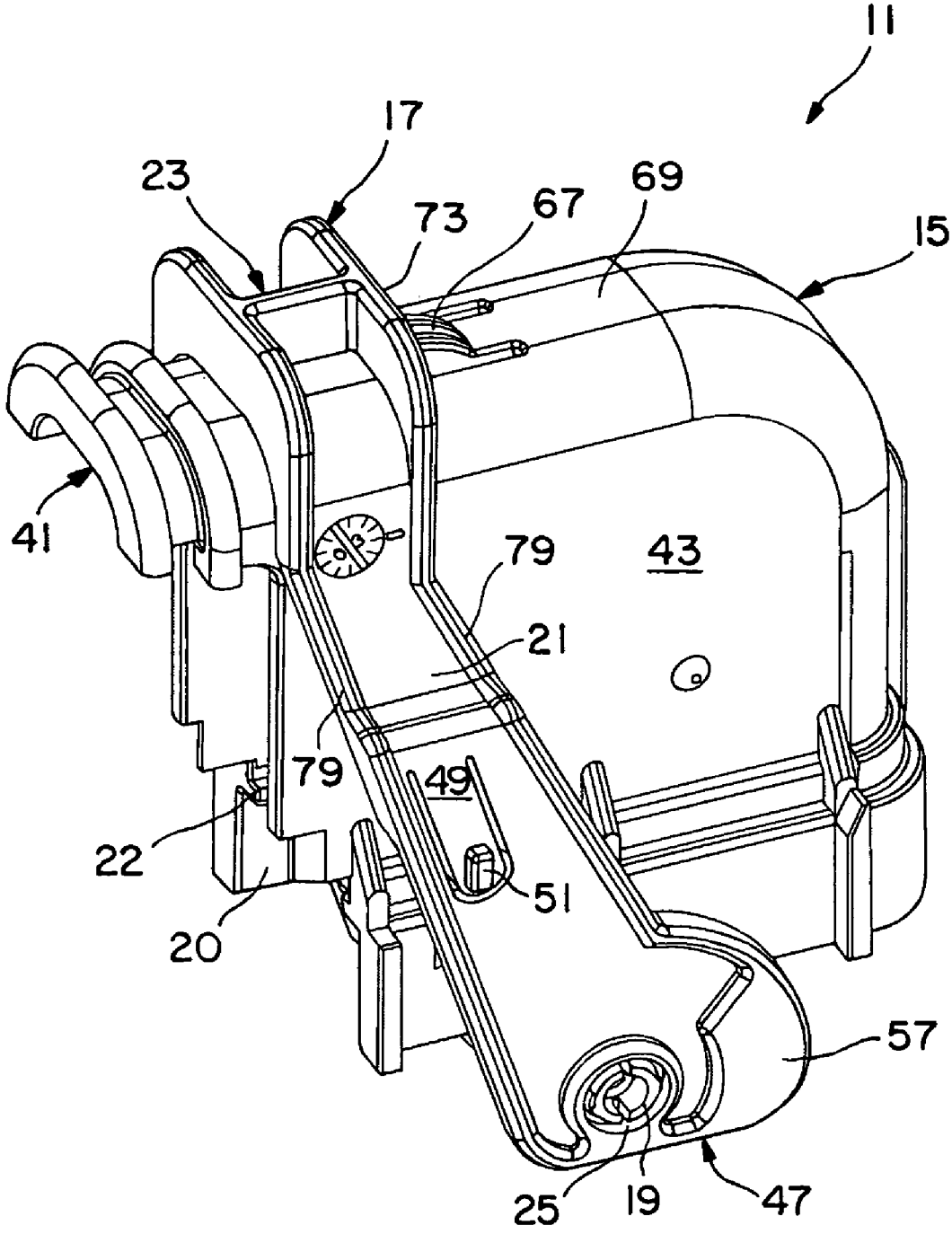
FIG. 4 shows the plug cover and the actuation lever of FIG. 2, with the actuation lever in the coupled position.

FIGS. 2 to 4 show only the connector cover 15 and the pivotal actuation lever 17. A receiving opening 20 is formed in the connector cover 15, for receiving the socket connector 13. The receiving opening 20 has an inwardly pointing rib 22 which engages in a corresponding groove in the housing of the socket connector 13, when the socket connector 13 is pushed (from the left as shown in FIG. 2) into the receiving opening 20 in the connector cover 15.

The pivotal actuation lever 17 serves to bring the socket connector 13 into mating connection with a plug connector (27 in FIG. 6) serving as a mating connector in the plug connector arrangement. To bring the socket connector 13 into mating connection with the plug connector 27, the pivotal actuation lever 17 is pivoted out of a free position as shown in FIGS. 1 and 2 through a middle position shown in FIG. 3 and into a coupled position shown in FIG. 4. In the free position of the actuation lever 17, the socket and plug connectors 13 and 27 are not fully mated. Conversely, in the coupled position of the pivotal actuation lever 17, the socket and plug connectors 13 and 27 are fully mated.

In FIGS. 2 to 4, only the connector cover 15 and the pivotal actuation lever 17 are illustrated. The socket connector 13 is omitted in these figures.

Figure 6:
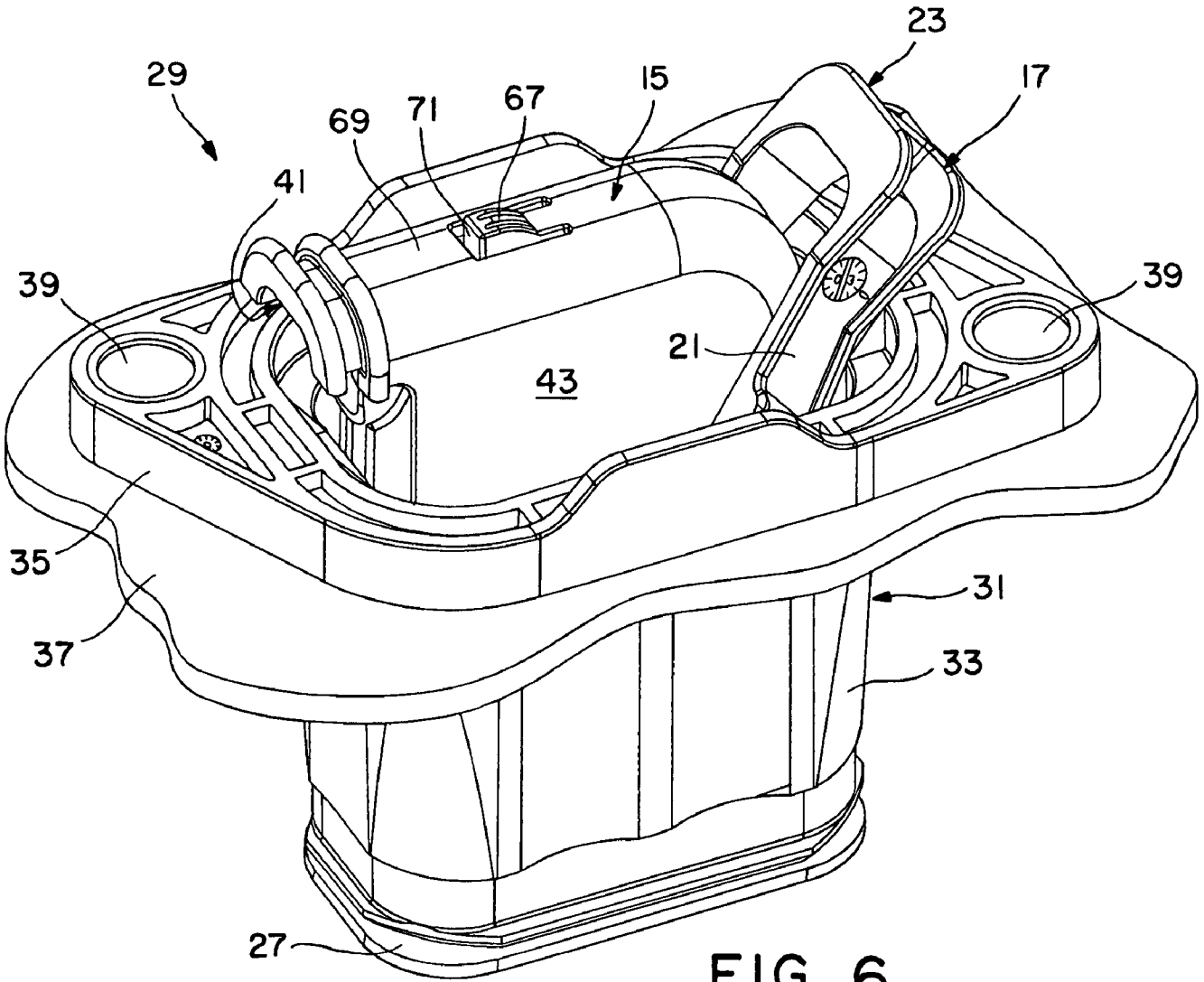
FIG. 6 shows a perspective view of a plug system according to an exemplary embodiment of the invention, the plug system having a plug shroud forming a surrounding housing in which the plug connector shown in FIG. 1 is located with the plug cover and the actuation lever and the mating connector before the mating connection is brought about by means of the actuation lever.
Figure 7:
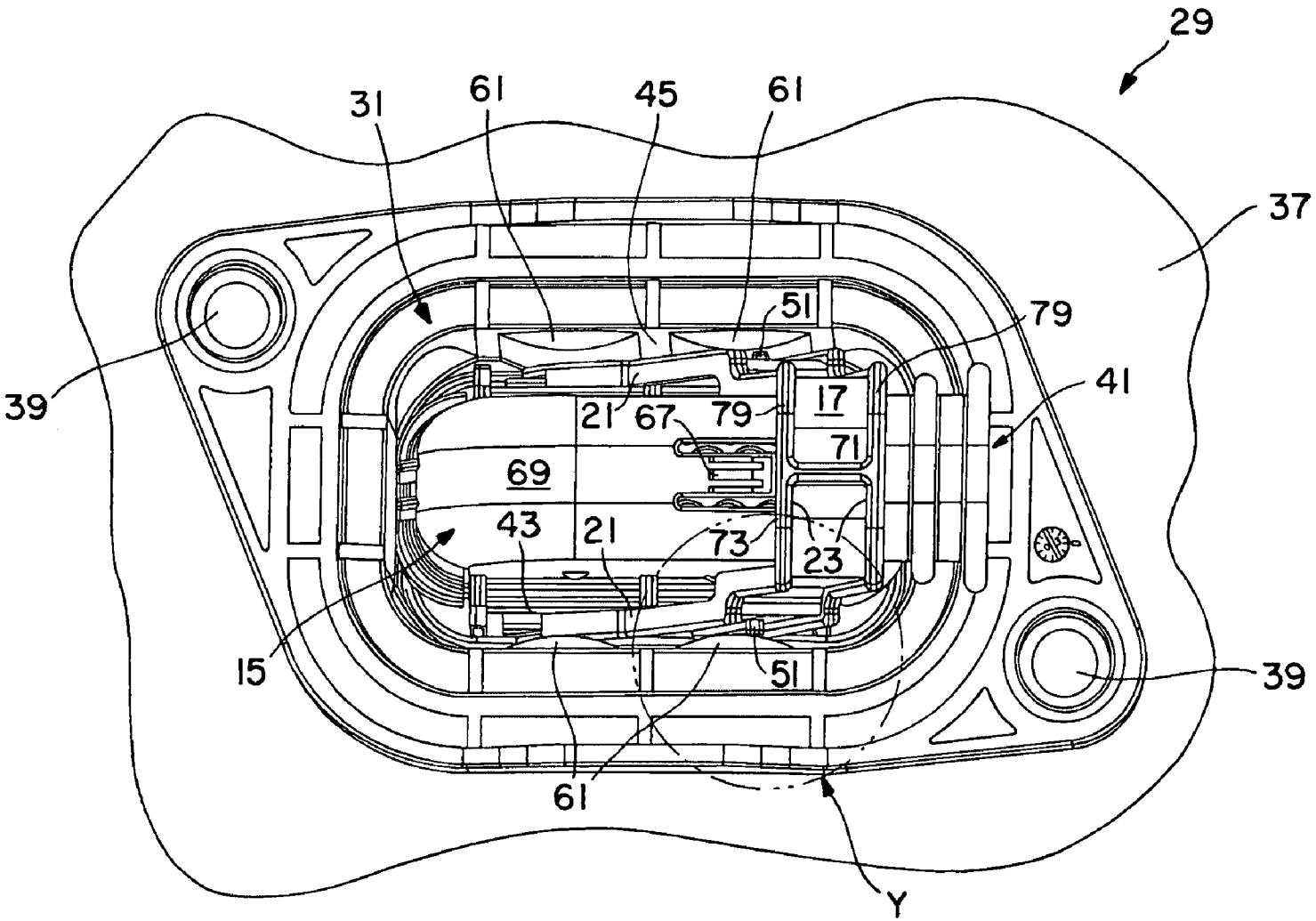
FIG. 7 shows a plan view from above of the plug system shown in FIG. 6, with the plug cover 15 and the actuation lever turned through 180° by comparison with the position shown in FIGS. 2 to 6, so that the cable opening 41 appears on the right in FIG. 7.

A complete interconnection system 29 is shown in FIGS. 6 and 7, with the connector cover 15 and the pivotal actuation lever 17 arranged on the socket connector 13. The plug connector 27 which may be brought into a mating connection with the socket connector 13, and a plug shroud 31 which receives the socket and plug connectors 13, 27 and the actuation lever 17, is shown in perspective view in FIG. 6 and in plan view in FIG. 7. The plug shroud 31 has a tube 33 which surrounds a substantial part of the socket connector 13, and on the upper side (as seen in FIG. 6) of the plug shroud 31, a flange 35 protrudes radially beyond the periphery of the tube 33. The flange 35 allows the plug shroud 31 to be placed on a device wall 37, which may for example be an engine compartment partition wall, a gearbox housing wall, another type of unit side wall, or the like. The flange 35 is provided on two diametrically opposite sides with a respective eyelet 39 by means of which the flange 35 of the plug shroud 31 can be fixed to the device wall 37 with screws or like fasteners.

The structural unit comprising the socket connector 13, the connector cover 15 and the pivotal actuation lever 17 only penetrates into the tube 33 of the plug shroud 31 far enough for the handle 23 to project sufficiently far above the flange 35 to enable it to be held comfortably to pivot the pivotal actuation lever 17. This penetration also forms a cable opening 41 at the top left-hand end, as seen in FIG. 6, of the connector cover 15 which projects above the plug shroud 31 far enough for the cable (not shown) connected to the contacts (also not shown) of the socket connector 13 to be fed unhindered out of the plug shroud 31.

While the foregoing description is of a socket connector 13 arranged in a housing or plug shroud 31 with a connector cover 15 and articulating lever arm 17 and a mating plug connector, the connector arrangement may be arranged the other way around, that is to say a plug connector may be disposed in the housing or plug shroud 31 with an articulating lever arm and the mating connector 27 may be a socket connector.

The plug connector 27 may be a mounted, for example, fixedly connected to a printed circuit board. In this case, the socket plug connector 13 will be pulled into an electrically mating connection in the direction of the plug connector 27 when the pivotal actuation lever 17 is actuated.

As best seen in the plan view of FIG. 7, the lateral lever arms 21 of the pivotal actuation lever 17 are located, respectively between one of two longitudinal outer sides 43 of the plug cover 15 and the respectively opposite longitudinal inner side 45 of the tube 33 of the plug shroud 31. Between the respective longitudinal outer side 43 and the longitudinal inner side 45 there is a spacing such that the lever arms 21 can be pivoted between the plug cover 13 and the plug shroud 31.

Figure 5:
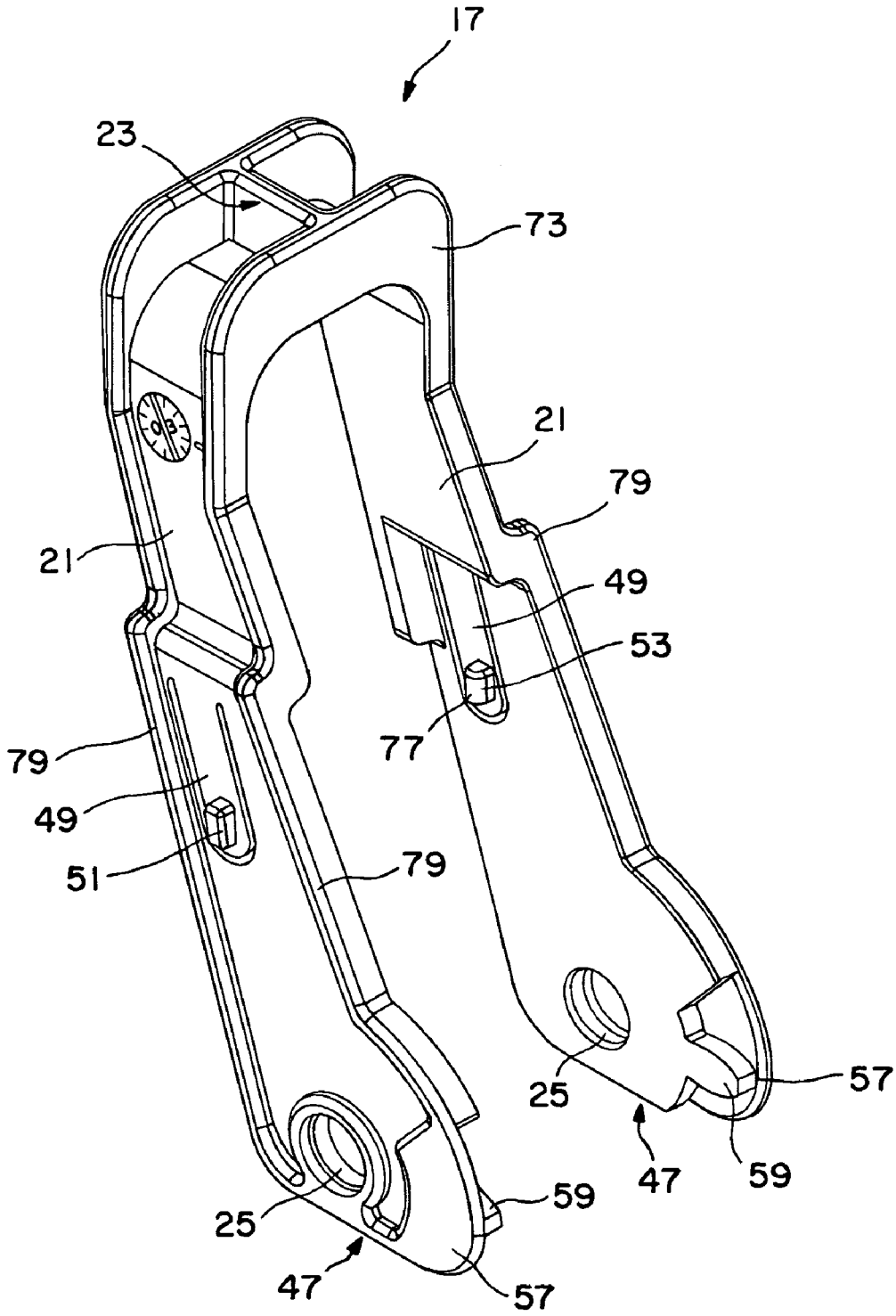
FIG. 5 shows a perspective view of the actuation lever of FIG. 1, with the plug connector and the plug cover omitted.

As can best be seen from FIG. 5, which shows a perspective view of the pivotal actuation lever 17 by itself, each of the two lever arms 21 has a spring tab 49 between the handle 23 and the free end 47 of the lever arm. The spring tab 49 is cut to protrude out of the respective lever arm 21. On the lower end of the spring tab 49 (as seen in FIG. 5) is a clamping projection 51 arranged on the outer side and a guide projection 53 arranged on the inner side. The spring tab 49 is resilient, so that it can be deflected elastically out of its relaxed position, shown in FIG. 5, in a direction perpendicular to the direction of the longitudinal extent of the respective lever arm 21.

Each of the two lever arms 21 has a lever arm base 57 on its free end 47, in which the pivot peg receiving opening 25 is formed, and on the front end of which (as seen in FIG. 5), a tooth 59 is formed. The tooth 59 meshes with mating teeth (not illustrated) on the plug connector 27 when the latter is pushed into the plug shroud 31 and the pivotal actuation lever 17 is pivoted. The mating teeth on the plug connector are constructed and arranged such that when the pivotal actuation lever 17 is pivoted relative to the socket connector 13 from the free position of FIG. 2 to the coupled position of FIG. 4, the mutually meshing teeth on the pivotal actuation lever 17 and the plug connector 27 draw the socket connector 13 toward the plug connector 27, bringing the plug connector 27 and the socket connector 13 into an electrical mating connection. When the actuation lever is pivoted in the reverse direction (from the coupled position of FIG. 4 to the free-position of FIG. 2) the plug connector 13 is withdrawn electrical contact with the plug connector 27.

Figure 8:
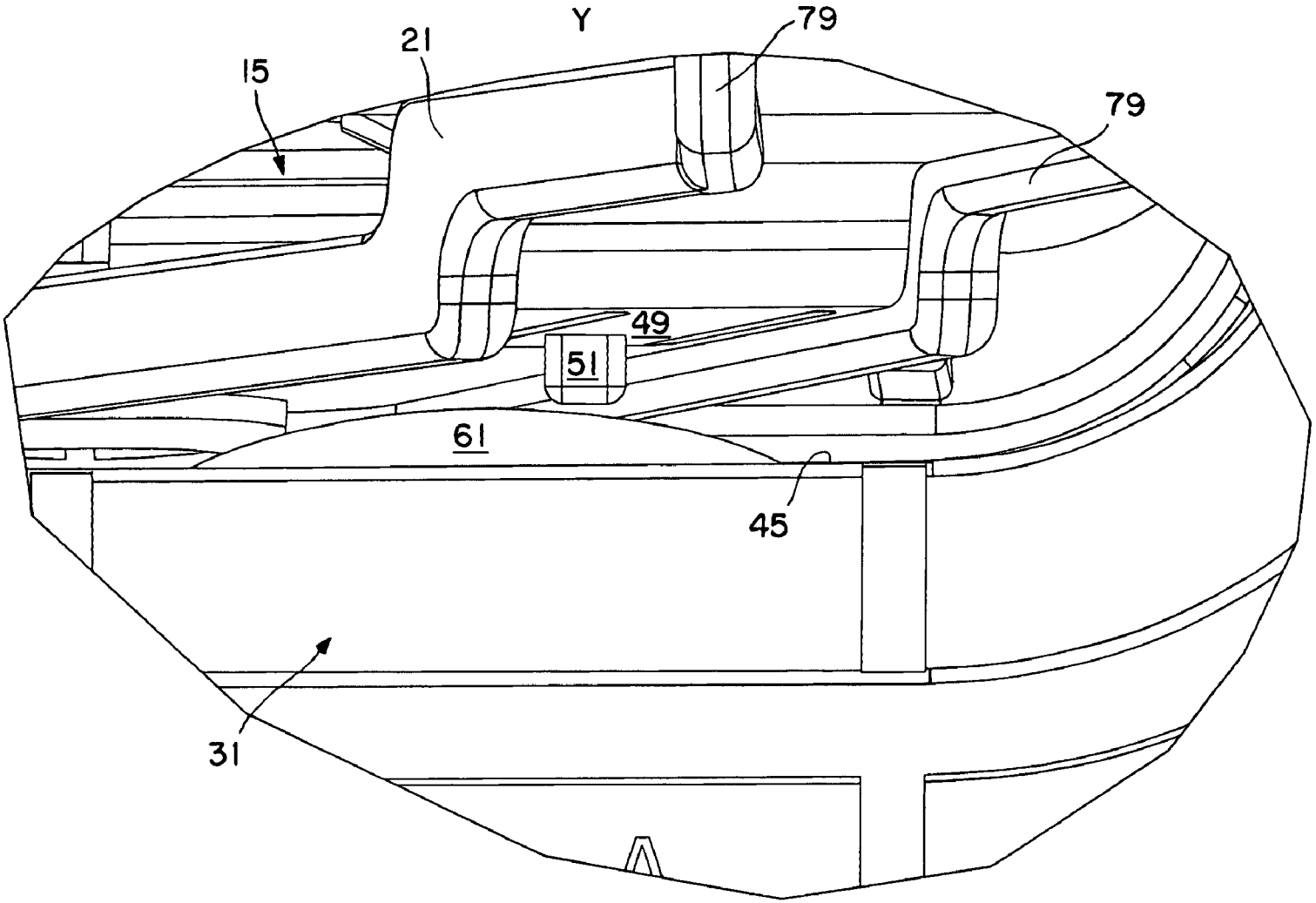
FIG. 8 shows an enlarged detail Y from FIG. 7, in which a clamping projection of the actuation lever and a mating clamping projection of the plug shroud are readily visible.

As FIG. 7 shows, and as is shown even more clearly in the detail in FIG. 8, the tube 33 of the plug shroud 31 is provided on its two longitudinal inner sides 45 in each case with two convex mating clamping projections 61 which protrude in the direction of the respectively opposing longitudinal outer side 43 of the connector cover 15.

On each of the two longitudinal outer sides 43 of the connector cover 15 there is arranged a ramped projection 63 which cooperates with the guide projection 53 on the inner side of the spring tab 49 on the respectively opposite lever arm 21 such that when the pivotal actuation lever 17 pivots from the free position illustrated in FIG. 2 to the coupled position shown in FIG. 4 the guide projection 53 runs up onto the ramped projection 63 just before the coupled position is reached. The spring tab 49 is therefore deflected outwardly until the clamping projection 51 engages the opposing mating clamping projection 61.

During this pivotal movement, the handle 23 of the pivotal actuation lever 17 slides over a lead-in ramp of a resilient latching knob 67 which is arranged on a cover wall 69. When the pivotal actuation lever 17 pivots into the coupled position, the latching knob 67 is disposed in the pivotal path of the handle 23 and is pushed downward as the actuation lever pivots from the free position of FIG. 2 to the coupled position of FIG. 4, overcoming a spring resistance of the latching knob 67. As soon as the handle 23 has completely passed the latching knob 67, the latching knob 67 springs upwardly and, a latching shoulder 71 disposed on the front face of the latching knob 67, engages a side wall 73, shown on the right in FIG. 1, of the handle 23. This engagement blocks the pivotal actuation lever 17 to prevent unintentional pivoting back in the direction of the free position, and it can only be released to pivot from the coupled position into the free position if the latching knob 67 is pressed downwardly.

In the embodiment illustrated in the figures, the ramped projection 63 is provided with a latching groove 75, and each of the guide projections 53 is provided with a latching tip 77 which is shaped to complement the latching groove 75 and latches into the latching groove 75 when the pivotal actuation lever 17 reaches the coupled position. The pivotal actuation lever 17 is thus fixed in its coupled position both by the cooperation of the latching groove 75 and the latching tip 77 and by means of the latching knob 67.

When the pivotal actuation lever 17 is in the coupled position and the clamping projections 51 on the pivotal actuation lever 17 are in engagement with the mating clamping projections 61 on the plug shroud 31 and these are supported against one another, in addition to being fixed to the plug connector 27, the socket connector 13 is fixed at the upper part of the plug shroud 31. As a result, the load on the electrical contacts in the event of jolting and vibration forces acting on the mass of connectors and the attached cables, which would have to be taken up solely by the front plug mechanism in the absence of the clamping device according to the invention, are minimised.

The actuation lever 17, which may be arranged directly on the socket connector 13 or on the connector cover 15, which covers the cable side of the socket connector 13, can be used not only to draw the socket connector 13 into electrical connection with the mating plug connector 27 and to disconnect them, but, as a result of the actuation lever 17 being latched to the socket connector 13 in the coupled position such that the socket connector 13 and the mating plug connector 27 are held pressed against one another, the actuation lever 17 can also take up the mechanical load acting in the axial direction. This is particularly successful if there is a respective resilient seal between the two connectors 13, 27 or between the plug shroud 31 and the device receiving the plug connector 27. These seals are held pressed together with elastic pretension when the actuation lever 17 is latched in the coupled position.

The clamping projection 51 is arranged on a spring tab 49 of the respective lever arm 21. Alternatively the entire lever arm 21 or at least a partial region thereof on which the clamping projection 51 is arranged may be resilient, with a corresponding axial play of the lever arm base 57 in relation to the associated pivot peg 19. In this case, when the guide projection 53 ran onto the associated ramped projection 63, the entire spring portion of the lever arm 21 would be deflected in a resilient manner in the direction of the tube 33 of the plug shroud 31.

In the embodiment illustrated, the pivotal actuation lever 17 is provided with a reinforcing bead 79 running peripherally around the contour thereof in order to give the pivotal actuation lever 17 mechanical strength. The spring tab 49 cut to protrude out of the respective lever arm 21 in the embodiment illustrated in the drawings allows the clamping projection 51 to be raised above the reinforcing bead 79. Thus, the clamping projection 51 can be urged into engagement with the mating clamping projection 61 on the plug shroud 31.

In the embodiment illustrated in the figures, the tube 33 of the plug shroud 31 has two convex mating clamping projections 61 on each longitudinal inner side thereof. The clamping projection 51 of each of the two lever arms 21 only cooperates with one of the two mating clamping projections 61 on the longitudinal inner side of the tube 33 opposite the clamping projection 51. The second mating clamping projection 61 on each respective longitudinal inner side 45 of the tube 33 is provided to assure engagement with the socket connector 13 whether the socket connector 13 is pushed into the plug shroud 31 oriented with the cable opening 41 towards the right, as shown in FIG. 7 or toward the left as shown in FIG. 6. Where this possibility does not need to be provided, only one mating clamping projection 61 is required on each of the two longitudinal outer sides 43 of the plug cover 15.

In an alternate exemplary embodiment of the invention, the actuation lever 17 is not arranged directly on the socket connector 13 but on the connector cover 15. In this embodiment, the pivot pegs 19 are not arranged on the housing of the socket connector 13, itself, but on the outside of the connector cover 15. Because the socket connector 13 is received with a substantially fixed seating in the connector cover 15, relative movement between the socket connector 13 and the connector cover 15 restrained, with the result that the clamping action between the projections 51 of the actuation lever 17 and the mating clamping projections 61 of the plug shroud 31 is sufficient to take up radially directed jolting and vibration forces, protecting the electrical contacts of the connector arrangement.

In another alternate exemplary embodiment, the actuation lever 17 has only one limb or lever arm 21. The single lever arm 21 is located only in one place between the socket connector 13 and the housing or plug shroud 31. The clamping projection 51 and the mating clamping projection 61 should be dimensioned such that when the actuation lever 17 is in the coupled position the socket connector 13 is pushed on the side having no actuation lever arm 21 directly against the inside of the housing 31 restraining relative movement between the socket connector 13 and the housing 31 on each of the two sides.

While the invention is illustrated and described with reference to an exemplary embodiment thereof, equivalent minor modifications and alternative structures are contemplated within the scope of the invention. For example, the mating clamping projections 61 may have a different shape from the convex one shown in the drawings. The mating clamping projections may for example also be constructed as lead-in ramps. It is also possible to manage without any mating clamping projections at all. In this case, the shape and dimensions of the ramped projections 63, the guide projections 53, the spring tabs 49 and the clamping projections 51 are selected such that the clamping projections 51 come into forceful enough engagement with the respective longitudinal inner side 45 of the tube 33 for the clamping fixation to be brought about between the socket connector 13 and the plug shroud 31 by means of the clamping projections 51.

What is claimed is:

1. An electrical connector arrangement, comprising:

a first connector arranged in a housing; and an actuation lever arranged on the first connector, the actuation lever having at least one tooth located at a free end, configured to engage a mating connector, and movable between a free position in which the first connector and the mating connector are unmated and a coupled position in which the two connectors are fully mated;

a portion of the actuation lever being disposed between the first connector and the housing, and having thereon a clamping projection which, in the coupled position, is in engagement with a mating clamping projection on the housing;

wherein the first connector has a mating clamping projection on each of two diametrically opposing sides thereof, the actuation lever is constructed as a two-armed lever having a respective lever arm on each of the two diametrically opposing sides of the first connector, and the lever arms each having a clamping projection positioned to engage the respective mating clamping projection;

wherein the clamping projections of each lever arm comprise a deflectable spring tab cut to protrude from the lever arm with a clamping projection on the spring tab;

wherein the actuation lever is constructed to be approximately U-shaped and has two limbs of this U-shape which each form one of the two lever arms, each of the limbs connected to a handle portion and terminating in a free end; and wherein each of the two limbs of the U-shaped actuation lever has an opening at the free end for receiving a pivot peg arranged on the first connector.

2. The connector arrangement according to claim 1, wherein the actuation lever is pivotal relative to the first connector.

3. The connector arrangement according to claim 1, wherein the first connector is a socket connector.

4. The connector arrangement according to claim 1, wherein the first connector is a plug connector.

5. The connector arrangement according to claim 1, wherein the actuation lever has on each side of the first connector a respective lever part having a respective clamping projection, and the housing has at corresponding locations on two mutually opposing inner wall regions a respective mating clamping projection.

6. The connector arrangement according to claim 1, wherein the clamping projection protrudes towards the housing.

7. The connector arrangement according to claim 6, wherein the mating clamping projection is formed on the housing and protrudes toward the lever.

8. The connector arrangement according to claim 1, wherein the clamping projection on the lever is resilient in the direction of the housing and is deflected toward the housing by movement of the actuation lever from the free position into the coupled position.

9. The connector arrangement according to claim 8, wherein the resilient clamping projection is formed by a resilient portion of the actuation lever.

10. The connector arrangement according to claim 8, wherein the first connector includes a ramp projection that urges the resilient lever region toward the mating clamping projection during the movement of the actuation lever from the free position into the coupled position, such that the clamping projection engages the mating clamping projection.

11. The connector arrangement according to claim 8, wherein the clamping projection on the lever is formed on a resilient portion of the actuation lever.

12. The connector arrangement according to claim 11, wherein the resilient portion of the actuation lever is formed by a spring tab cut to protrude out of the lever.

13. The connector arrangement according to claim 12, wherein the spring tab includes a clamping projection pointing towards the housing.

14. An electrical connector arrangement, comprising:

a first connector arranged in a housing; and an actuation lever arranged on the first connector, the actuation lever having at least one tooth located at a free end, configured to engage a mating connector, and movable between a free position in which the first connector and the mating connector are unmated and a coupled position in which the two connectors are fully mated;

a portion of the actuation lever being disposed between the first connector and the housing, and having thereon a clamping projection which, in the coupled position, is in engagement with a mating clamping projection on the housing;

wherein the first connector has a mating clamping projection on each of two diametrically opposing sides thereof, the actuation lever is constructed as a two-armed lever having a respective lever arm on each of the two diametrically opposing sides of the first connector, and the lever arms each having a clamping projection positioned to engage the respective mating clamping projection;

wherein the clamping projections of each lever arm comprise a deflectable spring tab cut to protrude from the lever arm with a clamping projection on the spring tab;

wherein the actuation lever is constructed to be approximately U-shaped and has two limbs of this U-shape which each form one of the two lever arms, each of the limbs connected to a handle portion and terminating in a free end; and wherein each of the two limbs of the U-shaped actuation lever has the at least one tooth located at its free end constructed to mesh with at least one correspondingly positioned mating tooth on the mating connector to bring about a relative movement between the first connector and the mating connector.

15. The connector arrangement according to claim 14, wherein the actuation lever is pivotal relative to the first connector.

16. The connector arrangement according to claim 14, wherein the first connector is a socket connector.

17. The connector arrangement according to claim 14, wherein the first connector is a plug connector.

18. The connector arrangement according to claim 14, wherein the actuation lever has on each side of the first connector a respective lever part having a respective clamping projection, and the housing has at corresponding locations on two mutually opposing inner wall regions a respective mating clamping projection.

19. The connector arrangement according to claim 14, wherein the clamping projection protrudes towards the housing.

20. The connector arrangement according to claim 19, wherein the mating clamping projection is formed on the housing and protrudes toward the lever.

21. The connector arrangement according to claim 14, wherein the clamping projection on the lever is resilient in the direction of the housing and is deflected toward the housing by movement of the actuation lever from the free position into the coupled position.

22. The connector arrangement according to claim 21, wherein the resilient clamping projection is formed by a resilient portion of the actuation lever.

23. The connector arrangement according to claim 21, wherein the first connector includes a ramp projection that urges the resilient lever region toward the mating clamping projection during the movement of the actuation lever from the free position into the coupled position, such that the clamping projection engages the mating clamping projection.

24. The connector arrangement according to claim 21, wherein the clamping projection on the lever is formed on a resilient portion of the actuation lever.

25. The connector arrangement according to claim 24, wherein the resilient portion of the actuation lever is formed by a spring tab cut to protrude out of the lever.

26. The connector arrangement according to claim 25, wherein the spring tab includes a clamping projection pointing towards the housing.

27. An actuation lever constructed to be mounted on a connector arranged in a housing, the actuation lever being movable between a free position and a coupled position to move the connector into and out of an electrical connection with a mating connector, the actuation lever having a clamping projection disposed between the connector and the housing and a latching tip extending opposite the clamping projection, the clamping projection being configured to engage a mating clamping projection on the housing opposite the clamping projection when the actuation lever is in the coupled position, the actuation lever having at least one tooth located at its free end constructed to mesh with at least one correspondingly positioned mating tooth on the mating connector to bring about a relative movement between the first connector and the mating connector.

28. The actuation lever according to claim 27, wherein the clamping projection on the lever is formed by a portion of the lever region which protrudes towards the surrounding housing when the actuation lever is arranged on the connector.

29. The actuation lever according to claim 28, wherein the clamping projection on the lever is formed on a lever portion which is resilient in the direction of the housing when the actuation lever is arranged on the connector.

30. The actuation lever according to claim 29, wherein the resilient lever portion is formed by a spring tab cut to protrude out of the lever.

31. The actuation lever according to claim 30, further comprising a clamping projection extending toward the housing provided on the spring tab.

* * * * *